US011834617B2

(12) United States Patent
Xu et al.

(10) Patent No.: US 11,834,617 B2
(45) Date of Patent: Dec. 5, 2023

(54) FLY ASH RECYCLING GASIFICATION FURNACE

(71) Applicant: HUANENG CLEAN ENERGY RESEARCH INSTITUTE, Beijing (CN)

(72) Inventors: Yue Xu, Beijing (CN); Lizhen Luo, Beijing (CN); Yongqiang Ren, Beijing (CN); Jiye Tao, Beijing (CN); Pengjie Wang, Beijing (CN); Xiaoyu Li, Beijing (CN); Gang Liu, Beijing (CN); Zhi Chen, Beijing (CN); Qiang Fan, Beijing (CN); Yuan Liu, Beijing (CN); Jianming Qin, Beijing (CN); Ping Wu, Beijing (CN); Ruichao Wang, Beijing (CN)

(73) Assignee: HUANENG CLEAN ENERGY RESEARCH INSTITUTE, Beijing (CN)

( * ) Notice: Subject to any disclaimer, the term of this patent is extended or adjusted under 35 U.S.C. 154(b) by 0 days.

(21) Appl. No.: 17/859,705

(22) Filed: Jul. 7, 2022

(65) Prior Publication Data

US 2022/0340828 A1 Oct. 27, 2022

Related U.S. Application Data

(63) Continuation of application No. PCT/CN2021/075401, filed on Feb. 5, 2021.

(30) Foreign Application Priority Data

Dec. 7, 2020 (CN) ..... 202011419102.9

(51) Int. Cl.
*C10J 3/84* (2006.01)

(52) U.S. Cl.
CPC ..... *C10J 3/84* (2013.01); *C10J 2300/093* (2013.01); *C10J 2300/1631* (2013.01); *C10J 2300/1807* (2013.01)

(58) Field of Classification Search
CPC ..... C10J 3/84; C10J 2300/093; C10J 2300/1631; C10J 2300/1807
See application file for complete search history.

(56) References Cited

U.S. PATENT DOCUMENTS

2011/0147666 A1* 6/2011 Troxclair ..... C10J 3/86 252/373
2013/0312328 A1* 11/2013 Xu ..... C10J 3/721 48/77
2016/0222306 A1* 8/2016 Tsang ..... C10J 3/485

FOREIGN PATENT DOCUMENTS

CN 107099337 A * 8/2017
CN 110484301 B * 10/2020 ..... C10J 3/54
(Continued)

OTHER PUBLICATIONS

Machine Translation of EP0499771A1 (Feb. 17, 2023) (Year: 2023).*

(Continued)

*Primary Examiner* — Matthew J Merkling
(74) *Attorney, Agent, or Firm* — Hodgson Russ LLP

(57) ABSTRACT

A fly ash recycling gasification furnace includes a fly ash burner, an ash remover, a fly ash storage tank, a variable pressure lock hopper, a fly ash blending system, an exhaust filter, and a backflushing nitrogen buffer tank. The fly ash burner is located on an inner wall of a hearth of the gasification furnace. The ash remover has an inlet connected to an outlet of a waste boiler of the gasification furnace. The fly ash storage tank is connected to a pressurized nitrogen inlet pipe, and a bottom outlet of the ash remover. The variable pressure lock hopper is connected to the fly ash (Continued)

storage tank. The fly ash blending system is connected to the variable pressure lock hopper and the fly ash burner. The exhaust filter is connected to the storage tank, the lock hopper and the blending system. The buffer tank is connected to the exhaust filter.

11 Claims, 1 Drawing Sheet

(56) References Cited

FOREIGN PATENT DOCUMENTS

| | | | | | |
|---|---|---|---|---|---|
| CN | 112877100 | A * | 6/2021 | ..... | B01D 45/18 |
| EP | 0499771 | A1 * | 8/1992 | | |
| WO | WO-2005049768 | A1 * | 6/2005 | ..... | C10J 3/466 |

OTHER PUBLICATIONS

Machine Translation of CN-107099337-A (Jul. 24, 2023) (Year: 2023).*
WIPO, International Search Report for PCT/CN2021/075401, dated Sep. 8, 2021.

* cited by examiner

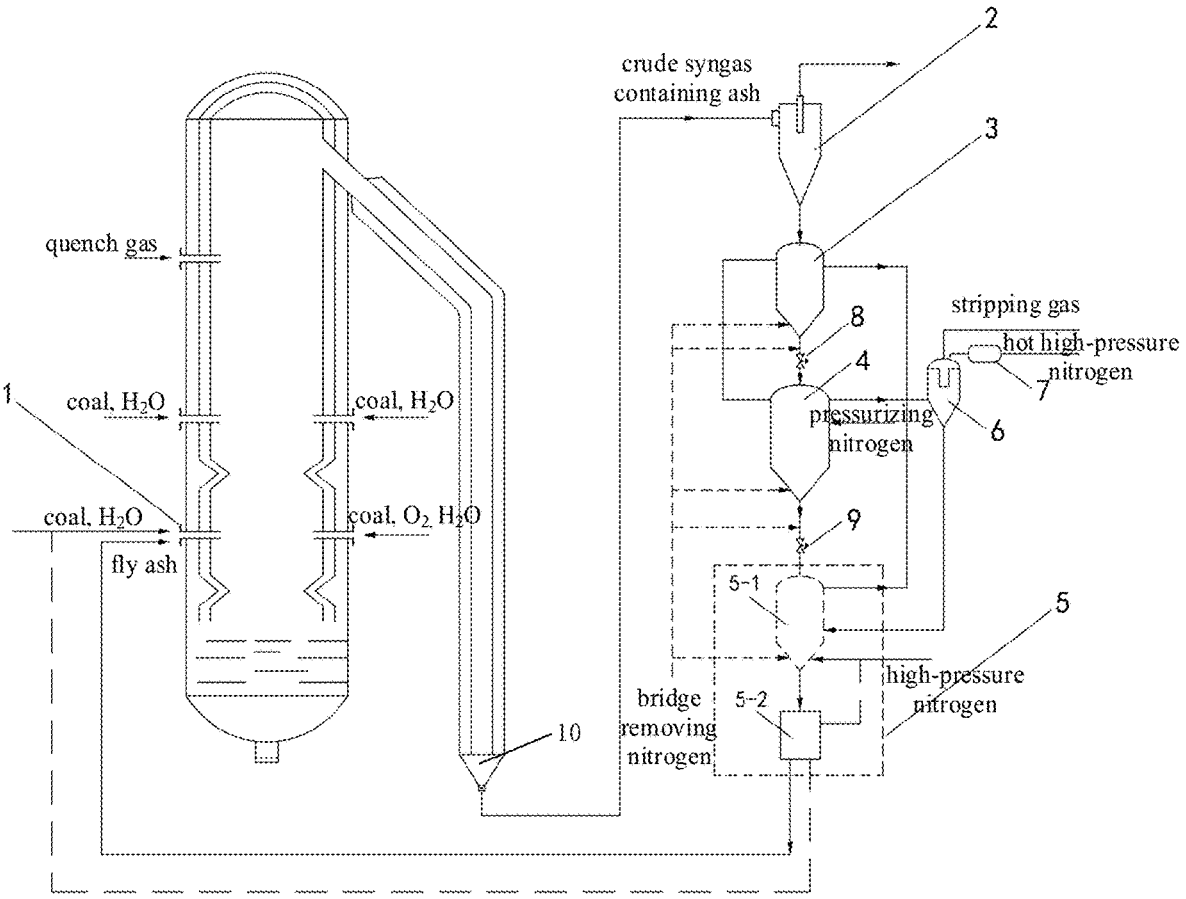
crude syngas
containing ash
2
3
quench gas
stripping gas
hot high-pressure
nitrogen
7
8
4
1
coal, $H_2O$
coal, $H_2O$
pressurizing
nitrogen
6
coal, $H_2O$
coal, $O_2$, $H_2O$
9
fly ash
5-1
5
high-pressure
nitrogen
bridge
removing
nitrogen
5-2
10

FLY ASH RECYCLING GASIFICATION FURNACE

CROSS-REFERENCE TO RELATED APPLICATIONS

This application is based on International Application PCT/CN2021/075401, filed Feb. 5, 2021, which claims priority to Chinese Patent Application No. 202011419102.9, filed Dec. 7, 2020, the entire disclosures of which are incorporated herein by reference.

FIELD

The present disclosure relates to a field of gasification furnaces, and more particularly to a fly ash recycling gasification furnace and a method of operating the fly ash recycling gasification furnace.

BACKGROUND

A coal gasification technology is a core technology for clean and efficient use of coal, and a key technology for an advanced energy system of clean coal power generation, coal chemical industry, coal-based polygeneration and the like, which affects operational reliability and economy of each system. With a rapid development of modern coal chemical projects, the coal gasification technology is developing towards enlargement, cleanness, high efficiency and applicability in a wide range of coal types. There are more and more types of coal gasification technologies, but there are still many problems that need to be solved urgently in the development process of efficient and clean coal gasification technologies at present.

In a gasification furnace system in the related art, fly ash is introduced to a coal grinding system. Due to an atmospheric pressure of the coal grinding system, the fly ash needs to be pressurized and then depressurized, which needs cumbersome equipment and processes, and causes a high energy consumption. Moreover, a ratio of fly ash to coal, oxygen or water is not easy to control. Meanwhile, the fly ash entering the coal grinding system will cause additional losses to a coal grinding machine, and increase maintenance cost of the system.

SUMMARY

In a first aspect of the present disclosure, a fly ash recycling gasification furnace is provided. The gasification furnace includes: a fly ash burner, an ash remover, a fly ash storage tank, a variable pressure lock hopper, a fly ash blending system, an exhaust filter, and a backflushing nitrogen buffer tank. The fly ash burner is located on an inner wall of a hearth of the gasification furnace. The ash remover has an inlet connected to an outlet of a waste boiler of the gasification furnace. The fly ash storage tank is connected to a pressurized nitrogen inlet pipe, and a bottom outlet of the ash remover, respectively. The variable pressure lock hopper is connected to the fly ash storage tank. The fly ash blending system is connected to the variable pressure lock hopper and the fly ash burner, respectively. The exhaust filter is connected to the fly ash storage tank, the variable pressure lock hopper and the fly ash blending system, respectively. The backflushing nitrogen buffer tank is connected to the exhaust filter. A gasification agent system of the gasification furnace is connected to the fly ash burner and the fly ash blending system, respectively.

In some embodiments, the fly ash blending system includes a fly ash buffer lock hopper, a density measuring device, a flow measuring device, an online carbon residue measuring device and a processor unit. The fly ash buffer lock hopper is connected to the variable pressure lock hopper and the fly ash burner, respectively, and connected with a high pressure nitrogen inlet pipe connected to a high pressure nitrogen control system. The density measuring device is configured to detect a density of the fly ash. The flow measuring device is configured to detect a flow of the fly ash. The online carbon residue measuring device is configured to detect a percentage of a carbon residue. The processor unit is connected to the gasification agent system of the gasification furnace and the high pressure nitrogen control system, respectively, and connected with the density measuring device, the flow measuring device and the online carbon residue measuring device, respectively.

In some embodiments, a first control valve is provided on a first connecting pipeline between the fly ash storage tank and the variable pressure lock hopper, and a second control valve is provided on a second connecting pipeline between the variable pressure lock hopper and the fly ash buffer lock hopper.

In some embodiments, a nitrogen bridge removing system is connected with the fly ash storage tank, the variable pressure lock hopper, the fly ash buffer lock hopper, the first control valve and the second control valve, respectively.

In some embodiments, an inlet pipe of the nitrogen bridge removing system is connected with a bottom of the fly ash storage tank, a bottom of the variable pressure lock hopper and a bottom of the fly ash buffer lock hopper, respectively.

In some embodiments, the fly ash burner and a plurality of pulverized coal burners are circumferentially evenly arranged in a gasification section of the gasification furnace.

In some embodiments, the fly ash burner and the plurality of pulverized coal burners are arranged on a same horizontal plane.

In some embodiments, the fly ash burner and the plurality of pulverized coal burners are deflected by 1° to 5° in a same direction.

In some embodiments, the fly ash burner faces a center of the hearth of the gasification furnace.

In some embodiments, the ash remover is a cyclone separator.

In a second aspect of the present disclosure, a method of operating the above-mentioned fly ash recycling gasification furnace is provided. The method includes: introducing crude syngas containing ash from a waste boiler into an ash remover to obtain crude syngas and fly ash; discharging the crude syngas from a top of the ash remover; introducing the fly ash into a fly ash storage tank from a bottom of the ash remover; introducing the fly ash into a variable pressure lock hopper when the fly ash storage tank reaches a first maximum level; stopping the fly ash from entering the variable pressure lock hopper when the fly ash storage tank reaches a first minimum level; opening a first relief valve of an exhaust filter to release pressure; closing the first relief valve when the fly ash storage tank reaches the first maximum level; pressurizing the variable pressure lock hopper to a predetermined pressure after the fly ash stops entering the variable pressure lock hopper; introducing the fly ash into the fly ash blending system; stopping the fly ash from entering the fly ash blending system when the variable pressure lock hopper reaches a second minimum level; opening a second relief valve of the exhaust filter to release pressure, and closing the second relief valve after pressure relief is completed; opening a balance pipeline valve between the variable pressure lock hopper and the fly ash storage tank to balance pressure; purging the fly ash collected by the exhaust filter into the fly ash blending system by high pressure nitrogen when the exhaust filter reaches a second maximum level; and introducing the fly ash into a hearth of the gasification furnace through a fly ash burner for another combustion cycle after the fly ash is blended by the fly ash blending system.

BRIEF DESCRIPTION OF THE DRAWINGS

FIG. 1 is a schematic diagram showing a fly ash recycling gasification furnace in an embodiment of the present disclosure.

REFERENCE NUMERALS

1: fly ash burner; 2: ash remover; 3: fly ash storage tank; 4: variable pressure lock hopper; 5: fly ash blending system; 5-1: fly ash buffer lock hopper; 5-2: processor unit; 6: exhaust filter; 7: backflushing nitrogen buffer tank; 8: first control valve; 9: second control valve; and 10: waste boiler.

DETAILED DESCRIPTION

Embodiments of the present disclosure are described in detail below, examples of which are illustrated in the drawings, which shall not be construed to limit the present disclosure.

In an embodiment of the present disclosure, a fly ash recycling gasification furnace and a method of operating the fly ash recycling gasification furnace are provided, which is capable of making use of the fly ash carbon residue, simplifying a transportation process of the fly ash, reducing a transportation load of ground coal and pulverized coal, and controlling a ratio of fly ash to coal, oxygen or water, thereby improving the overall efficiency of the gasification furnace and energy utilization.

FIG. 1 is a schematic diagram showing a fly ash recycling gasification furnace in an embodiment of the present disclosure.

As shown in FIG. 1, the fly ash recycling gasification furnace includes a fly ash burner 1, an ash remover 2, a fly ash storage tank 3, a variable pressure lock hopper 4, a fly ash blending system 5, an exhaust filter 6, and a backflushing nitrogen buffer tank 7. The fly ash burner 1 is located on an inner wall of a hearth of the gasification furnace. The ash remover 2 has an inlet connected to an outlet of a waste boiler 10 of the gasification furnace. The fly ash storage tank 3 is connected to a pressurized nitrogen inlet pipe, and a bottom outlet of the ash remover 2, respectively. The variable pressure lock hopper 4 is connected to the fly ash storage tank 3. The fly ash blending system 5 is connected to the variable pressure lock hopper 4 and the fly ash burner 1, respectively. The exhaust filter 6 is connected to the fly ash storage tank 3, the variable pressure lock hopper 4 and the fly ash blending system 5, respectively. The backflushing nitrogen buffer tank 7 is connected to the exhaust filter 6. A gasification agent system of the gasification furnace is connected to the fly ash burner 1 and the fly ash blending system 5 respectively.

The fly ash blending system 5 comprises a fly ash buffer lock hopper 5-1, a density measuring device, a flow measuring device, an online carbon residue measuring device and a processor unit 5-2. The fly ash buffer lock hopper 5-1 is connected to the variable pressure lock hopper 4 and the fly ash burner 1, respectively, and connected with a high pressure nitrogen inlet pipe connected to a high pressure nitrogen control system. The density measuring device is configured to detect a density of the fly ash. The flow measuring device is configured to detect a flow of the fly ash. The online carbon residue measuring device is configured to detect a percentage of a carbon residue. The processor unit is connected to the gasification agent system of the gasification furnace and the high pressure nitrogen control system, respectively, and connected with the density measuring device, the flow measuring device and the online carbon residue measuring device, respectively.

A first control valve 8 is provided on a first connecting pipeline between the fly ash storage tank 3 and the variable pressure lock hopper 4, and a second control valve 9 is provided on a second connecting pipeline between the variable pressure lock hopper 4 and the fly ash buffer lock hopper 5-1.

A nitrogen bridge removing system is connected with the fly ash storage tank 3, the variable pressure lock hopper 4, the fly ash buffer lock hopper 5-1, the first control valve 8 and the second control valve 9, respectively.

An inlet pipe of the nitrogen bridge removing system is connected with a bottom of the fly ash storage tank 3, a bottom of the variable pressure lock hopper 4 and a bottom of the fly ash buffer lock hopper 5-1, respectively.

The fly ash burner 1 and a plurality of pulverized coal burners are evenly arranged in a gasification section of the gasification furnace in a circumferential direction of the gasification furnace. The fly ash burner 1 and the plurality of pulverized coal burners are arranged on a same horizontal plane. For example, the fly ash burner 1 and the plurality of pulverized coal burners are deflected by 1° to 5° in a same direction.

The fly ash burner 1 faces a center of the hearth of the gasification furnace.

Compared with the existing technology, the present disclosure has the following beneficial effects.

The present disclosure provides the fly ash recycling gasification furnace with the fly ash burner. The crude syngas containing ash from the waste boiler of the gasification furnace is separated through the ash remover, and is introduced into the fly ash blending system through the fly ash storage tank and the variable pressure lock hopper in turn. After detection and calculation, the crude syngas is introduced into the hearth of the gasification furnace through the fly ash burner for another combustion cycle. The gasification furnace has a reasonable structure design, which makes full use of the fly ash carbon residue. The fly ash is introduced into the fly ash burner through the variable pressure lock hopper and the fly ash blending system at high pressure, which simplifies a transportation process of the fly ash, reduces a transportation load of ground coal and pulverized coal, and reduces additional losses to a coal grinding machine. In addition, low-pressure transportation processes and equipment are removed, which simplifies control processes, and avoids blockage caused by low-pressure transportation, such that the efficiency and reliability are high. Meanwhile, through the fly ash blending system, a ratio of the fly ash to coal, oxygen or water entering the gasification furnace may be controlled, thereby improving the overall efficiency of the gasification furnace and energy utilization.

Furthermore, the density measuring device may monitor a solid-gas ratio of the fly ash in real time, the flow measuring device may monitor a flow rate of the fly ash in real time, and the online carbon residue measuring device may monitor the carbon residue amount in the fly ash in real time, which may be analyzed and processed by the processor unit to obtain results. Then, those results may be fed back to the gasification agent system to control the amount of fly ash entering the gasification furnace. The fly ash is re-pressurized by a high-pressure nitrogen system and then enters the gasification furnace. In this way, the ratio of fly ash to coal, oxygen or water entering the gasification furnace may be precisely controlled to improve the efficiency of the gasification furnace and energy utilization.

Furthermore, the first control valve and the second control valve may quickly control feeding and discharging of the fly ash according to the material levels of the fly ash storage tank and the variable pressure lock hopper, thereby realizing a high automation degree.

Furthermore, the nitrogen bridge removing system may be configured to prevent materials from bridging, thereby improving safety and stability of the system.

Furthermore, the nitrogen bridge removing system may be configured to remove bridges on the bottom of the fly ash storage tank, the bottom of the variable pressure lock hopper and the bottom of the fly ash buffer lock hopper where bridging and blockage often occur, which has a strong pertinence and a high efficiency, and saves nitrogen.

Furthermore, the fly ash burner and a plurality of pulverized coal burners are circumferentially evenly arranged in a gasification section of the gasification furnace, which makes fly ash uniform to feed and easy to blend with pulverized coal.

Furthermore, the fly ash burner and the plurality of pulverized coal burners are arranged on a same horizontal plane, such that the fly ash and the pulverized coal meet at a center of the gasification furnace, thereby improving a uniformity of combustion.

Furthermore, the fly ash burner and the plurality of pulverized coal burners are deflected by 1° to 5° in a same direction, such that the fly ash and the pulverized coal meet at a center of the gasification furnace in a form of tangent circles to form a stable cyclone, thereby further improving the uniformity of combustion.

Furthermore, the fly ash burner faces a center of the hearth of the gasification furnace, such that the fly ash may be quickly introduced into a combustion center of the gasification furnace with a high efficiency.

A method of operating the above-mentioned fly ash recycling gasification furnace includes: introducing crude syngas containing ash from a waste boiler 10 into an ash remover 2 to obtain crude syngas and fly ash; discharging the crude syngas from a top of the ash remover 2; introducing the fly ash into a fly ash storage tank 3 from a bottom of the ash remover 2; introducing the fly ash into a variable pressure lock hopper 4 when the fly ash storage tank 3 reaches a first maximum level; stopping the fly ash from entering the variable pressure lock hopper 4 when the fly ash storage tank 3 reaches a first minimum level; opening a first relief valve of an exhaust filter 6 to release pressure; closing the first relief valve when the fly ash storage tank 3 reaches the first maximum level; pressurizing the variable pressure lock hopper 4 to a predetermined pressure after the fly ash stops entering the variable pressure lock hopper 4; introducing the fly ash into the fly ash blending system 5; stopping the fly ash from entering the fly ash blending system 5 when the variable pressure lock hopper 4 reaches a second minimum level; opening a second relief valve of the exhaust filter 6 to release pressure, and closing the second relief valve after pressure relief is completed; opening a balance pipeline valve between the variable pressure lock hopper 4 and the fly ash storage tank 3 to balance pressure; purging the fly ash collected by the exhaust filter 6 into the fly ash blending system 5 by high pressure nitrogen when the exhaust filter 6 reaches a second maximum level; and introducing the fly ash into a hearth of the gasification furnace through a fly ash burner for another combustion cycle after the fly ash is blended by the fly ash blending system 5.

The method of operating the above-mentioned fly ash recycling gasification furnace is provided in the present disclosure, which is capable of making full use of the fly ash carbon residue, simplifying a transportation process of the fly ash, reducing a transportation load of ground coal and pulverized coal, and controlling a ratio of fly ash to coal, oxygen or water, thereby improving the overall efficiency of the gasification furnace and energy utilization.

As shown in FIG. 1, an ash remover 2 has an inlet connected to an outlet of a waste boiler 10 of the gasification furnace. A fly ash storage tank 3 is connected to a bottom outlet of the ash remover 2. A variable pressure lock hopper 4 is connected to the fly ash storage tank 3. A first control valve 8 is provided on a connecting pipeline between the fly ash storage tank 3 and the variable pressure lock hopper 4. A fly ash blending system 5 is connected to the variable pressure lock hopper 4. The fly ash storage tank 3 is connected with a pressurized nitrogen inlet pipe. An exhaust filter 6 is connected to the fly ash storage tank 3, the variable pressure lock hopper 4 and the fly ash blending system 5, respectively. A backflushing nitrogen buffer tank 7 is connected to the exhaust filter 6. A fly ash burner 1 is connected to the fly ash blending system 5. The fly ash burner 1 is located an inner wall of a hearth of the gasification furnace. A gasification agent system of the gasification furnace is connected to the fly ash burner 1 and the fly ash blending system 5, respectively.

The fly ash blending system 5 includes a fly ash buffer lock hopper 5-1, a density measuring device, a flow measuring device, an online carbon residue measuring device and a processor unit 5-2. The density measuring device, the flow measuring device and the online carbon residue measuring device are connected to the processor unit 5-2, respectively. The fly ash buffer lock hopper 5-1 is connected to the variable pressure lock hopper 4 and the fly ash burner 1, respectively. A second control valve 9 is provided on a connecting pipeline between the variable pressure lock hopper 4 and the fly ash buffer lock hopper 5-1. The fly ash buffer lock hopper 5-1 is connected with a high pressure nitrogen inlet pipe, and the high pressure nitrogen inlet pipe is connected to a high pressure nitrogen control system. The processor unit 5-2 is connected to the gasification agent system of the gasification furnace and the high pressure nitrogen control system, respectively.

The fly ash storage tank 3, the variable pressure lock hopper 4, the fly ash buffer lock hopper 5-1, the first control valve 8 and the second control valve 9 are all connected with a nitrogen bridge removing system. A bottom of the fly ash storage tank 3, a bottom of the variable pressure lock hopper 4 and a bottom of the fly ash buffer lock hopper 5-1 are respectively connected to an inlet pipe of the nitrogen bridge removing system.

A fly ash outlet branch is provided between the ash remover 2 and the fly ash storage tank 3, and is provided with a stripping and replacement device. The stripping and replacement device has an inlet connected to a nitrogen system, a solid outlet connected to a fly ash silo, and a gas outlet connected to a tail gas treatment system. The excess fly ash may be drawn out and recycled after stripping.

The ash remover 2 is preferably a cyclone separator.

The fly ash burner 1 faces a center of the hearth of the gasification furnace. The fly ash burner 1 and a plurality of pulverized coal burners are circumferentially evenly arranged in a gasification section of the gasification furnace, and arranged on a same horizontal plane. Preferably, the fly ash burner 1 and the plurality of pulverized coal burners are deflected by 1° to 5° in a same direction.

A method of operating the above-mentioned fly ash recycling gasification furnace is provided. The method includes steps as follows.

Crude syngas containing ash from a waste boiler 10 is introduced into an ash remover 2. The crude syngas may be introduced to a next section from a top of the cyclone, and the fly ash may be introduced into a fly ash storage tank 3 from a bottom of the cyclone. When the fly ash storage tank 3 reaches a set maximum level, a first control valve 8 is opened to introduce the fly ash into a variable pressure lock hopper 4. When the fly ash storage tank 3 reaches a set minimum level, the first control valve 8 is closed, and a relief valve connected to an exhaust filter 6 is opened to release pressure. When the fly ash storage tank 3 reaches the set maximum level, the relief valve is closed, and the above-mentioned operations are repeated. During the above-mentioned processes, if the fly ash storage tank 3 does not give an alarm indicating the minimum level within 1 minute, the corresponding bridge removal pipeline is opened for bridge removal, and the bridge removal pipeline is closed until the material level reaches a set stable state.

After the first control valve 8 is closed, the variable pressure lock hopper 4 is pressurized to 4 MPa. A second control valve 9 is then opened to introduce the fly ash into a fly ash blending system 5. When the variable pressure lock hopper 4 reaches a set minimum level, the second control valve 9 is closed, and a relief valve connected to the exhaust filter 6 is opened to release pressure. The relief valve is closed after pressure relief is completed. A balance pipeline valve between the variable pressure lock hopper 4 and the fly ash storage tank 3 is opened to balance pressure, and the above-mentioned operations are repeated. During the above-mentioned processes, if the variable pressure lock hopper 4 does not give an alarm indicating the minimum level within 1 minute, the corresponding bridge removal pipeline is opened for bridge removal, and the bridge removal pipeline is closed until the material level reaches a set stable state.

If the fly ash buffer lock hopper 5-1 does not give an alarm indicating the minimum level within 1 minute, the corresponding bridge removal pipeline is opened for bridge removal, and the bridge removal pipeline is closed until the material level reaches a set stable state. A vent pipe between the fly ash buffer lock hopper 5-1 and the exhaust filter 6 is a spare line, which is opened only when the system needs to release pressure. The fly ash collected by the exhaust filter 6 is purged into the fly ash buffer lock hopper 5-1 of the fly ash blending system 5 by high pressure nitrogen.

The above-mentioned operations are repeated. The density measuring device detects a density of the fly ash, the flow measuring device detects a flow of the fly ash, and the online carbon residue measuring device detects a percentage of carbon residue, which are analyzed and processed by a processor unit 5-2 to obtain results. Those results are fed back to a gasification agent system of the gasification furnace to control the amount of fly ash entering the gasification furnace. The fly ash is re-pressurized by the high-pressure nitrogen system and then enters the gasification furnace for another combustion cycle.

The present disclosure is further explained by the following embodiment.

A 1260 t/d two-section dry pulverized coal pressurized gasification furnace having a fly ash output of 8124 kg/h was provided, and the fly ash was returned to a first-section fly ash burner of the gasification furnace for gasification reaction.

There were four pulverized coal burners and one fly ash burner in the first section. 8124 kg/h of pulverized coal, 7344 kg/h of oxygen and 790 kg/h of steam were fed into each of the pulverized coal burners. 8124 kg/h of fly ash was fed to the fly ash burner.

There were two pulverized coal burners in a second section. 5938 kg/h of pulverized coal and 1696.9 kg/h of steam were fed to each of the pulverized coal burners.

Four pulverized coal burners and one fly ash burner were evenly arranged in the first section of the gasification furnace at a same angle, and were clockwise deflected by 1.5°. The five burners form a stable gasification tangent circle in the first section of the gasification furnace, which was conducive to slag capture. In the second section of the gasification furnace, two pulverized coal burners was centrosymmetric.

The fly ash was captured by the ash remover, and was blended in the fly ash blending system to a solid-gas ratio of 10 kg fly ash/kg $N_2$ and a pressure of 3.5 MPa, and then was sent to the fly ash burner. The fly ash carbon residue measured by the online carbon residue measuring device was 40%. Through empirical calculation, the fly ash burner sprayed 2938 kg/h of oxygen, and 325 kg/h of steam.

The fly ash was returned to the fly ash burner of the gasification furnace for recycling without affecting the reaction and stable operation of the gasification furnace. The gasification syngas was increased by 7217 $Nm^3/h$, and the slag was increased by 1950 kg/h, which showed a reduced loss of the coal grinding machine, and a reduced load of the transportation system.

The above-mentioned embodiments are only partial. Though some terms are used in the present disclosure, it does not exclude the possibility of using other technical terms. Those terms are only used for the convenience of description and explanation, which cannot be construed to limit the spirit and scope of the present disclosure. The above is only to further illustrate the present disclosure with embodiments to facilitate easier understanding, but it is not construed as a limitation to the definition of the present disclosure. Any technical extension or recreation made according to the present disclosure shall fall within the scope of the claims of the present disclosure.

What is claimed is:

1. A fly ash recycling gasification furnace, comprising:

a fly ash burner, located on an inner wall of a hearth of the gasification furnace;

an ash remover, having an inlet connected to an outlet of a waste boiler of the gasification furnace;

a fly ash storage tank, connected to a pressurized nitrogen inlet pipe, and a bottom outlet of the ash remover;

a variable pressure lock hopper, connected to the fly ash storage tank;

a fly ash blending system, connected to the variable pressure lock hopper and the fly ash burner;

an exhaust filter, connected to the fly ash storage tank, the variable pressure lock hopper and the fly ash blending system; and a backflushing nitrogen buffer tank, connected to the exhaust filter.

2. The fly ash recycling gasification furnace according to claim 1, wherein the fly ash blending system comprises:

a fly ash buffer lock hopper, connected to the variable pressure lock hopper and the fly ash burner, and connected with a high pressure nitrogen inlet pipe connected to a high pressure nitrogen control system;

a density measuring device, configured to detect a density of the fly ash;

a flow measuring device, configured to detect a flow of the fly ash;

an online carbon residue measuring device, configured to detect a percentage of a carbon residue; and a processor unit, connected to the gasification furnace and the high pressure nitrogen control system, and connected with the density measuring device, the flow measuring device and the online carbon residue measuring device.

3. The fly ash recycling gasification furnace according to claim 2, wherein a first control valve is provided on a first connecting pipeline between the fly ash storage tank and the variable pressure lock hopper, and a second control valve is provided on a second connecting pipeline between the variable pressure lock hopper and the fly ash buffer lock hopper.

4. The fly ash recycling gasification furnace according to claim 3, wherein a nitrogen bridge removing system is connected with the fly ash storage tank, the variable pressure lock hopper, the fly ash buffer lock hopper, the first control valve and the second control valve.

5. The fly ash recycling gasification furnace according to claim 4, wherein an inlet pipe of the nitrogen bridge removing system is connected with a bottom of the fly ash storage tank, a bottom of the variable pressure lock hopper and a bottom of the fly ash buffer lock hopper.

6. The fly ash recycling gasification furnace according to claim 1, wherein the fly ash burner and a plurality of pulverized coal burners are circumferentially evenly arranged in a gasification section of the gasification furnace.

7. The fly ash recycling gasification furnace according to claim 6, wherein the fly ash burner and the plurality of pulverized coal burners are arranged on a same horizontal plane.

8. The fly ash recycling gasification furnace according to claim 7, wherein the fly ash burner and the plurality of pulverized coal burners are deflected by 1 to 5 in a same direction.

9. The fly ash recycling gasification furnace according to claim 1, wherein the fly ash burner faces a center of the hearth of the gasification furnace.

10. The fly ash recycling gasification furnace according to claim 1, wherein the ash remover is a cyclone separator.

11. A method of operating a fly ash recycling gasification furnace, comprising:

introducing crude syngas containing ash from a waste boiler into an ash remover to obtain crude syngas and fly ash;

discharging the crude syngas from a top of the ash remover;

introducing the fly ash into a fly ash storage tank from a bottom of the ash remover;

introducing the fly ash into a variable pressure lock hopper when the fly ash storage tank reaches a first maximum level;

stopping the fly ash from entering the variable pressure lock hopper when the fly ash storage tank reaches a first minimum level;

opening a first relief valve of an exhaust filter to release pressure;

closing the first relief valve when the fly ash storage tank reaches the first maximum level;

pressurizing the variable pressure lock hopper to a predetermined pressure after the fly ash stops entering the variable pressure lock hopper;

introducing the fly ash into a fly ash blending system;

stopping the fly ash from entering the fly ash blending system when the variable pressure lock hopper reaches a second minimum level;

opening a second relief valve of the exhaust filter to release pressure, and closing the second relief valve after pressure relief is completed;

opening a balance pipeline valve between the variable pressure lock hopper and the fly ash storage tank to balance pressure;

purging fly ash collected by the exhaust filter into the fly ash blending system by high pressure nitrogen when the exhaust filter reaches a second maximum level; and introducing the fly ash into a hearth of the gasification furnace through a fly ash burner for another combustion cycle after the fly ash is blended by the fly ash blending system.

* * * * *